US010874262B1

(12) United States Patent
Huang

(10) Patent No.: US 10,874,262 B1
(45) Date of Patent: Dec. 29, 2020

(54) SOAP DISPENSING NOZZLE STRUCTURE

(71) Applicant: HYDROTEK CORPORATION, Nantou (TW)

(72) Inventor: Su Huang, Nantou Hsien (TW)

(73) Assignee: HYDROTEK CORPORATION, Nantou (TW)

( * ) Notice: Subject to any disclaimer, the term of this patent is extended or adjusted under 35 U.S.C. 154(b) by 0 days.

(21) Appl. No.: 16/582,952

(22) Filed: Sep. 25, 2019

(51) Int. Cl.
*A47K 5/14* (2006.01)
*A47K 5/12* (2006.01)

(52) U.S. Cl.
CPC . *A47K 5/14* (2013.01); *A47K 5/12* (2013.01)

(58) Field of Classification Search
CPC ..... A47K 5/12; A47K 5/14; B05B 11/3097; B05B 7/0018; A45D 27/12; A45D 27/10
USPC ..... 222/190
See application file for complete search history.

(56) References Cited

U.S. PATENT DOCUMENTS 3,351,105 A * 11/1967 Di Perna ..... E03C 1/046 141/18
8,820,585 B1 * 9/2014 Banks ..... B05B 7/0037 222/190
2009/0184134 A1 * 7/2009 Ciavarella ..... A47K 5/14 222/135
2009/0184136 A1 * 7/2009 Ciavarella ..... B05B 11/3067 222/190
2009/0294477 A1 * 12/2009 Ciavarella ..... B05B 7/0037 222/190
2009/0308894 A1 * 12/2009 Ophardt ..... A47K 5/1211 222/190
2013/0175296 A1 * 7/2013 Gray ..... A47K 5/1207 222/135
2014/0203047 A1 * 7/2014 McNulty ..... B05B 11/00442 222/190

* cited by examiner

*Primary Examiner* — Patrick M. Buechner
(74) *Attorney, Agent, or Firm* — Sinorica, LLC

(57) ABSTRACT

A soap dispensing nozzle structure is mounted to a soap dispenser. The soap dispenser includes a soap bottle. The soap bottle is connected with a conveying member. The conveying member is connected with a dispensing member. The dispensing member has a dispensing opening. The dispensing opening is provided with a joint. The joint is connected with a soap dispensing nozzle. The soap dispensing nozzle includes a nozzle body. The nozzle body has a mounting portion, a body portion, and a reduced portion. The nozzle body has a passage therein. The passage has a pressuring hole. Thereby, through the reduced portion and the pressurizing hole, the force of discharging the liquid soap is strong, and it is not easy to remain excessive residual foam.

8 Claims, 6 Drawing Sheets

SOAP DISPENSING NOZZLE STRUCTURE

FIELD OF THE INVENTION

The present invention relates to a soap dispensing nozzle structure, and more particularly to a soap dispensing nozzle structure mounted to a soap dispenser.

BACKGROUND OF THE INVENTION

Taking into account factors such as personal hygiene and convenience, a soap dispenser is used in most public places. The soap dispenser has a container filled with hand soap or liquid soap. By pumping the hand soap or liquid soap in the container, the hand soap or liquid soap is discharged through a nozzle, so that the soap dispenser can supply a certain amount of the hand soap or liquid soap. In addition to solving the problems of personal hygiene and cleanliness, the soap dispenser also brings considerable convenience.

However, the nozzle of the soap dispenser generally has a hexagonal or straight hole. This nozzle makes the force of spraying foam less powerful. If it is used for a long period of time, it will easily cause residual soap or foam in the dispensing opening. Under the influence of gravity, the residual soap or foam will slowly form water droplets to drip downward. In addition to leaving the dripping soap on the side of the sink or on the ground, it causes cleaning problems. Besides, the dripping soap will increase the additional consumption of soap to cause a waste. Accordingly, the inventor of the present invention has devoted himself based on his many years of practical experiences to solve these problems.

SUMMARY OF THE INVENTION

The primary object of the present invention is to provide a soap dispensing nozzle structure, which enables the force of discharging the liquid soap to be strong. A suck-back function is generated after the discharge is completed. There is no excessive residual foam to form water droplets, thereby solving the problem of cleaning.

In order to achieve the aforesaid object, a soap dispensing nozzle structure is provided. The soap dispensing nozzle structure is mounted to a soap dispenser. The soap dispenser comprises a soap bottle. The soap bottle is connected with a conveying member. The conveying member is connected with a dispensing member. The dispensing member has a dispensing opening. The dispensing opening is provided with a joint. The joint is connected with a soap dispensing nozzle. The soap dispensing nozzle includes a nozzle body. The nozzle body has a mounting portion, a body portion and a reduced portion that are arranged from top to bottom in sequence. The mounting portion is coupled to the joint. The nozzle body has a passage therein. The passage has a straight hole and a pressuring hole. The pressurizing hole has a diameter that is reduced downward. The soap dispensing nozzle has a discharge outlet at an exit of the pressurizing hole.

The pressurizing hole of the present invention is gradually reduced downward, enabling the force of discharging the liquid soap to be strong, and a suck-back effect is generated after the discharge is completed. There is no excessive residual foam to form water droplets, thereby solving the problem of cleaning and reducing the consumption of the liquid soap to avoid a waste.

DETAILED DESCRIPTION OF THE PREFERRED EMBODIMENTS

Embodiments of the present invention will now be described, by way of example only, with reference to the accompanying drawings.

Figure 1:
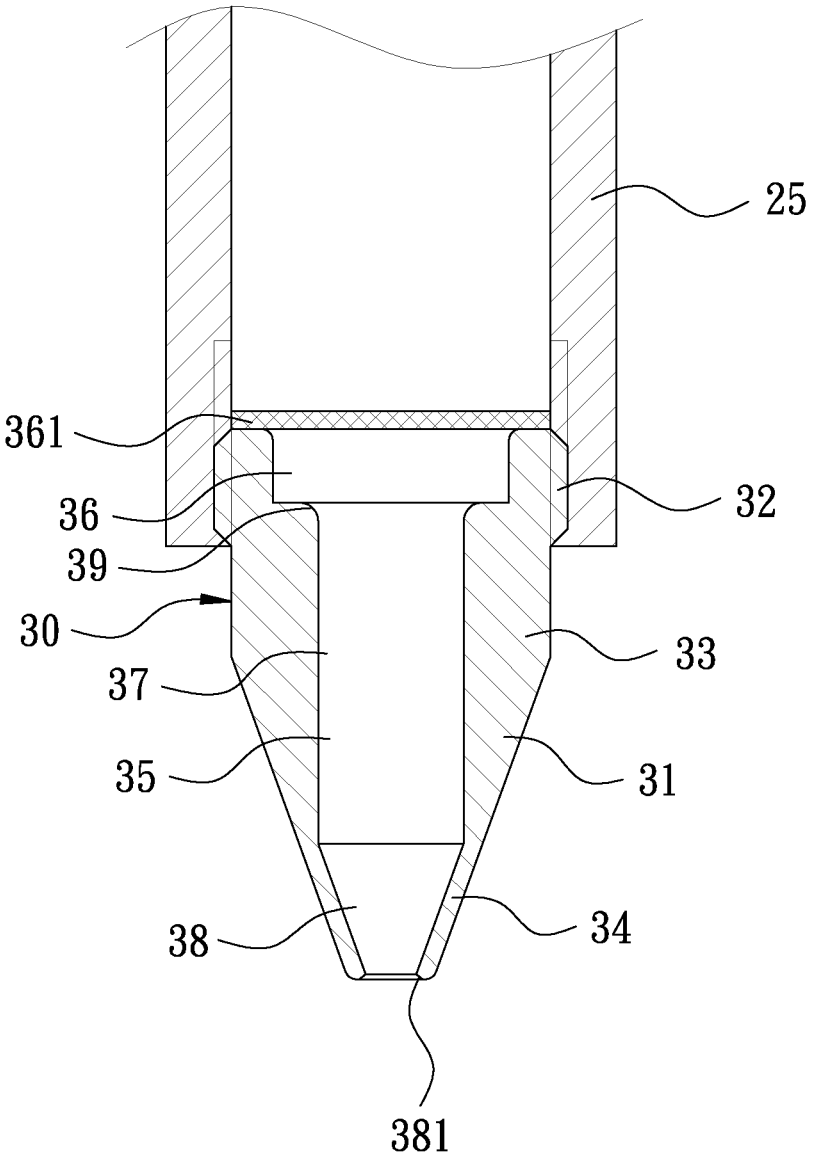
FIG. 1 is a partial cross-sectional view in accordance with a first embodiment of the present invention.

FIG. 1 is a partial cross-sectional view in accordance with a first embodiment of the present invention. The present invention discloses a soap dispensing nozzle structure mounted to a soap dispenser 100. The soap dispenser 100 comprises a soap bottle 20. The soap bottle 20 is connected with a conveying member 21. The conveying member 21 is connected with a dispensing member 22. The dispensing member 22 has a dispensing opening 24. The soap bottle 20, the conveying member 21 and the dispensing member 22 are in communication with each other. The dispensing opening 24 is provided with a joint 25. The joint 25 is connected with a soap dispensing nozzle 30.

The soap dispensing nozzle 30 is connected to the dispensing opening 24 so that the soap bottle 20 is in communication with the soap dispensing nozzle 30. The soap dispensing nozzle 30 comprises a nozzle body 31. The nozzle body 31 has a mounting portion 32, a body portion 33 and a reduced portion 34 that are arranged from top to bottom in sequence. The outer surface of the mounting portion 32 is formed with a thread to be coupled to the joint 25. The body portion 33 has a cylindrical shape and is connected to the mounting portion 32 and the reduced portion 34. The outer diameter of the reduced portion 34 is gradually reduced downward from the body portion 33, so that the reduced portion 34 is slightly tapered. The nozzle body 31 has a passage 35 therein. The passage 35 has a foaming hole 36, a straight hole 37, and a pressuring hole 38. The foaming hole 36 is located in the mounting portion 32. The foaming hole 36 is in communication with the dispending opening 24. One side of the foaming hole 36 is provided with a foaming net 361. The straight hole 37 is located in body portion 33. The straight hole 37 is in communication with the foaming hole 36. A curved annular surface 39 is formed between the straight hole 37 and the foaming hole 36. The pressurizing hole 38 is in communication with the straight hole 37. The diameter of the pressurizing hole 38 is reduced downward, so that the pressurizing hole 38 has a trapezoidal cross section. The pressurizing hole 38 is located in the reduced portion 34. The soap dispensing nozzle 30 has a discharge outlet 381 at an exit of the pressurizing hole 38. The inner diameter of the discharge outlet 381 is gradually increased outward.

Figure 2:
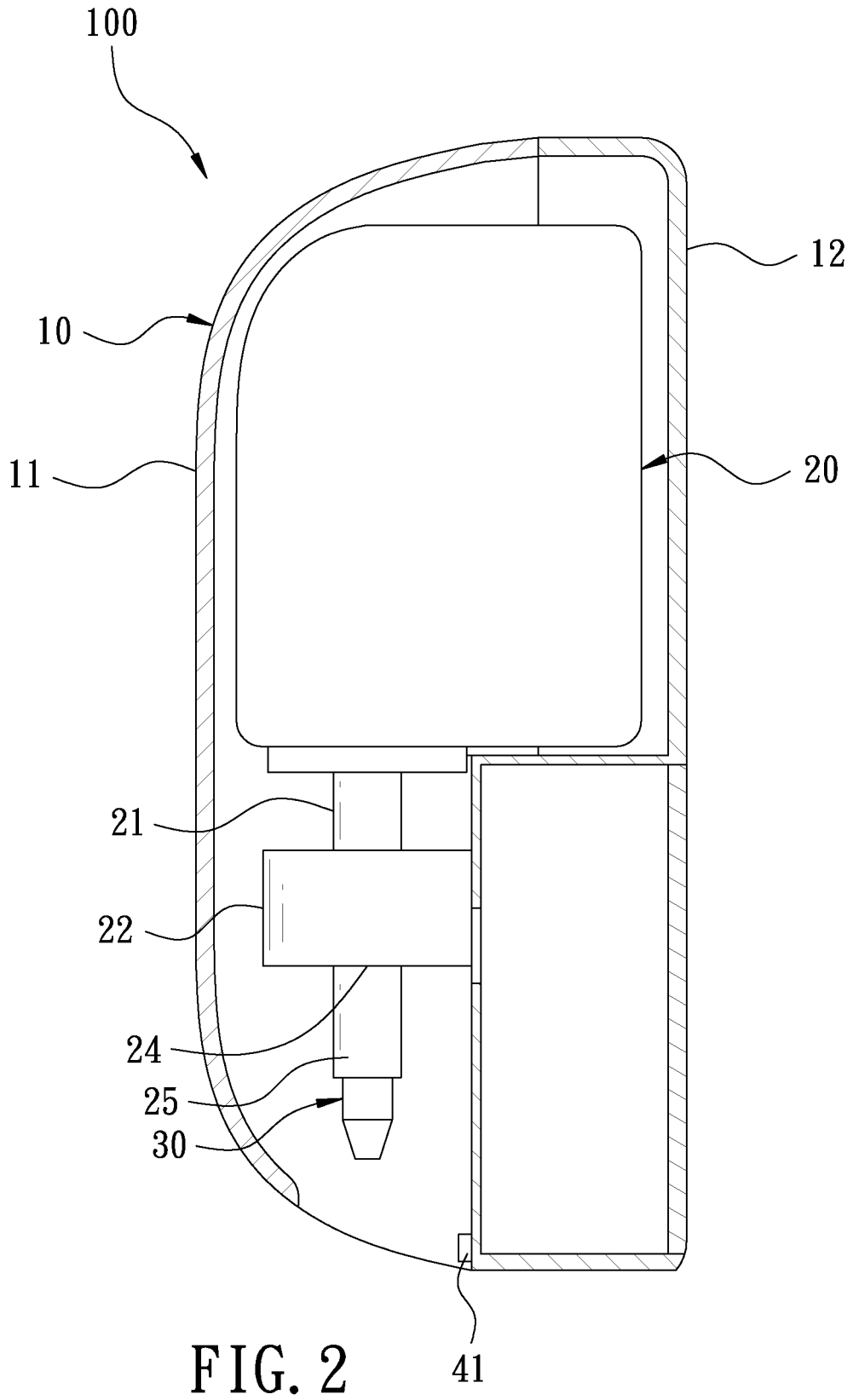
FIG. 2 is a cross-sectional view in accordance with the first embodiment of the present invention.

FIG. 2 is a cross-sectional view in accordance with the first embodiment of the present invention. The soap dispenser 100 is an automatic foam soap dispenser, comprising a casing 10, a soap bottle 20, and the soap dispensing nozzle 30. The casing 10 has a front casing 11 and a rear casing 12. The front housing 11 and the rear housing 12 are assembled to each other. The soap bottle 20 is received in the casing 10. The soap bottle 20 is connected to the conveying member 21. The conveying member 21 is connected to the dispensing member 22. In this embodiment of the present invention, the dispending member 22 may be a pump-type, push-type or valve-type automatic soap dispensing device. The automatic soap dispensing device can be aerated or not. The first embodiment of the present invention can be aerated as an example. The dispensing member 22 includes a power unit to provide the required power. The dispensing member 22 is electrically connected to a sensor 41. The sensor 41 is disposed in the casing 10 adjacent to the conveying member 21. After the sensor 41 senses the user, a quantitative amount of liquid soap is outputted by the dispensing member 22. The dispensing member 22 has the dispensing opening 24. The soap bottle 20, the conveying member 21 and the dispensing member 22 are in communication with each other. The dispensing opening 24 is provided with the joint 25. The joint 25 is connected with the soap dispensing nozzle 30.

Figure 3:
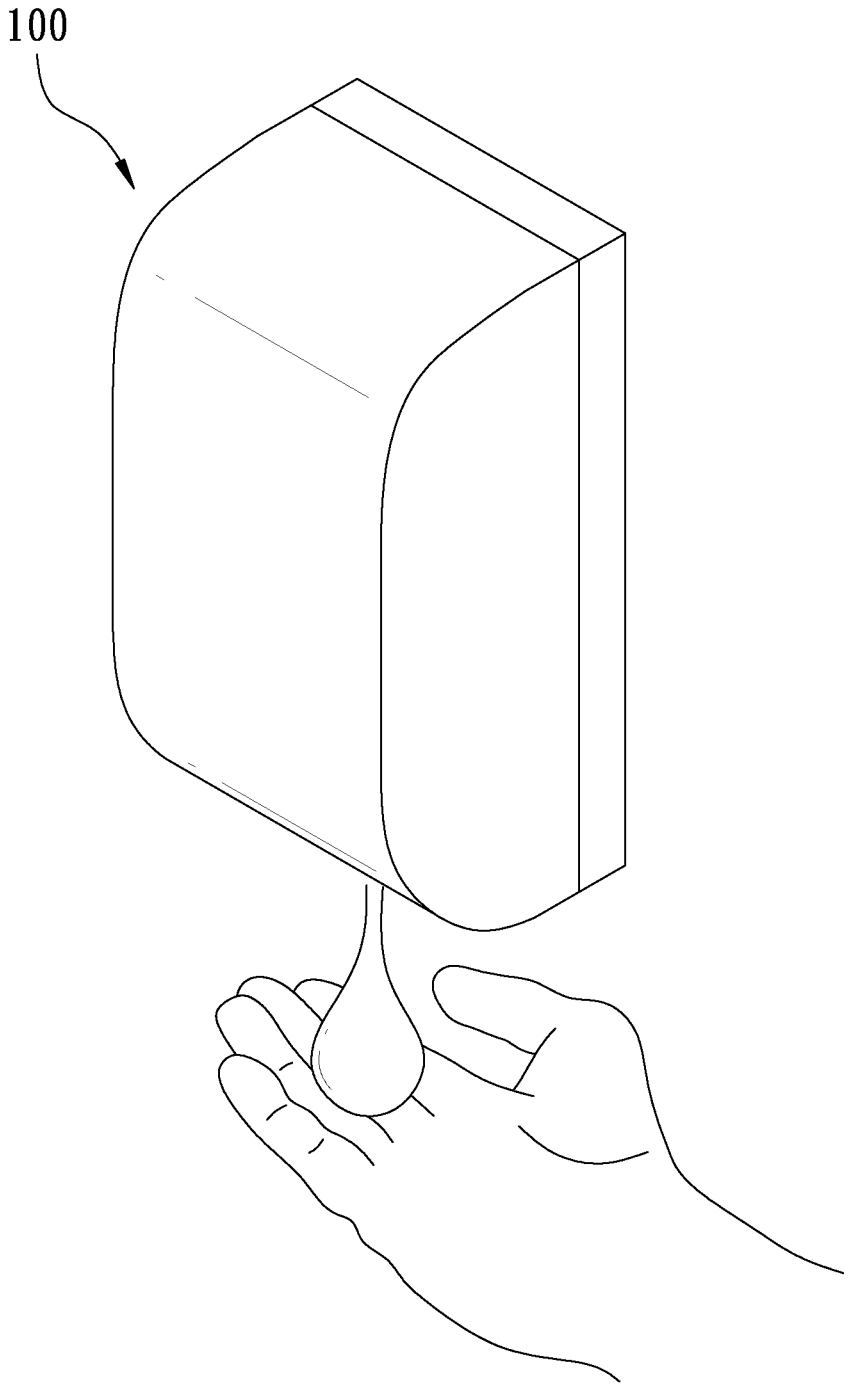
FIG. 3 is a first schematic view in accordance with the first embodiment of the present invention when in use.

FIG. 3 is a first schematic view in accordance with the first embodiment of the present invention when in use. When the user's hand is close to the soap dispenser 100, the sensor 41 triggers a conveying instruction to the dispensing member 22, so that the dispensing member 22 conveys the liquid soap in the soap bottle 20 to the passage 35 via the conveying member 21 together with the air of the conveying member 21. Then, the liquid soap and the air are sufficiently mixed in the foaming hole 36 through the foaming net 361 in the foaming hole 36 to form foaming liquid soap. The foaming liquid soap smoothly passes through the straight hole 37 via the curved annular surface 39 and then flows out from the discharge outlet 381 of the pressuring hole 38, such that the user is given a quantitative amount of foaming liquid soap for use.

Figure 4:
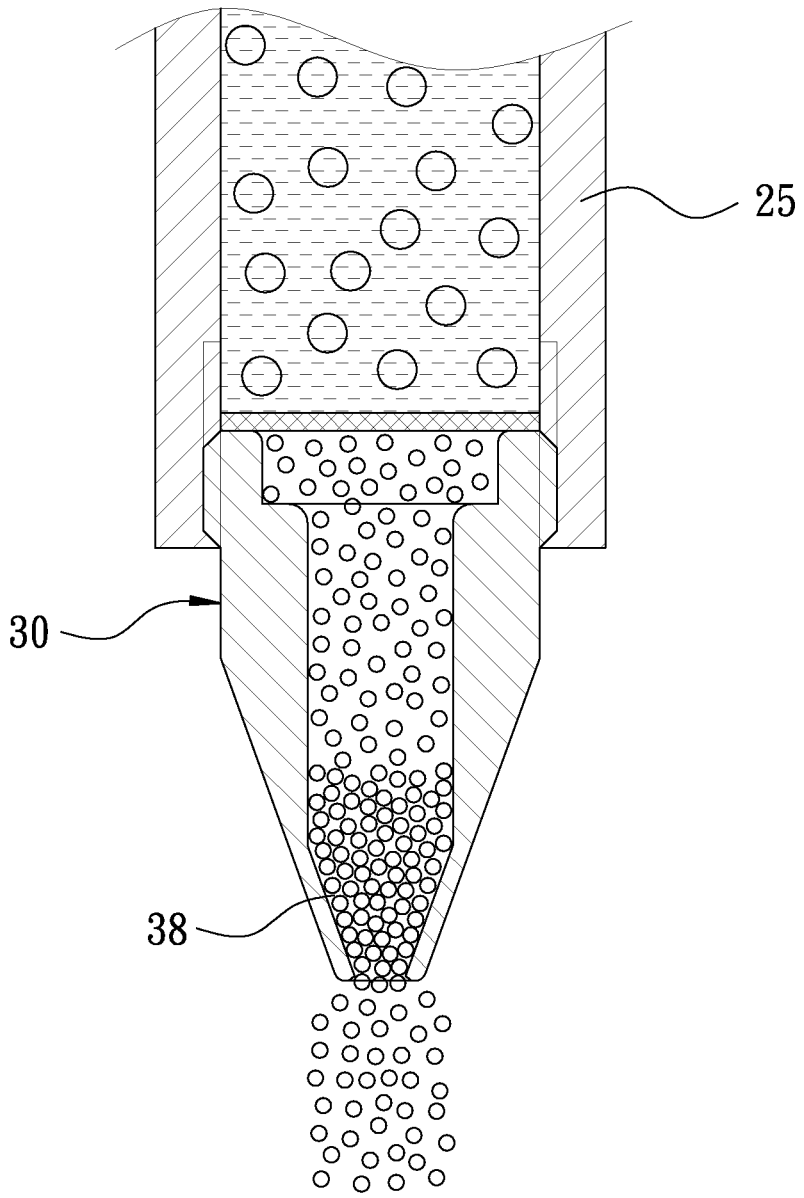
FIG. 4 is a second schematic view in accordance with the first embodiment of the present invention when in use.

FIG. 4 is a second schematic view in accordance with the first embodiment of the present invention when in use. When the foaming liquid soap flows through the pressurizing hole 38, since the pressurizing hole 38 is reduced downward to provide a pressurizing effect, the sprayed foam has a stronger force. When the discharge is completed, there is no excessive residual foam to form water droplets, thereby solving the problem of cleaning and reducing the consumption of the liquid soap.

Figure 5:
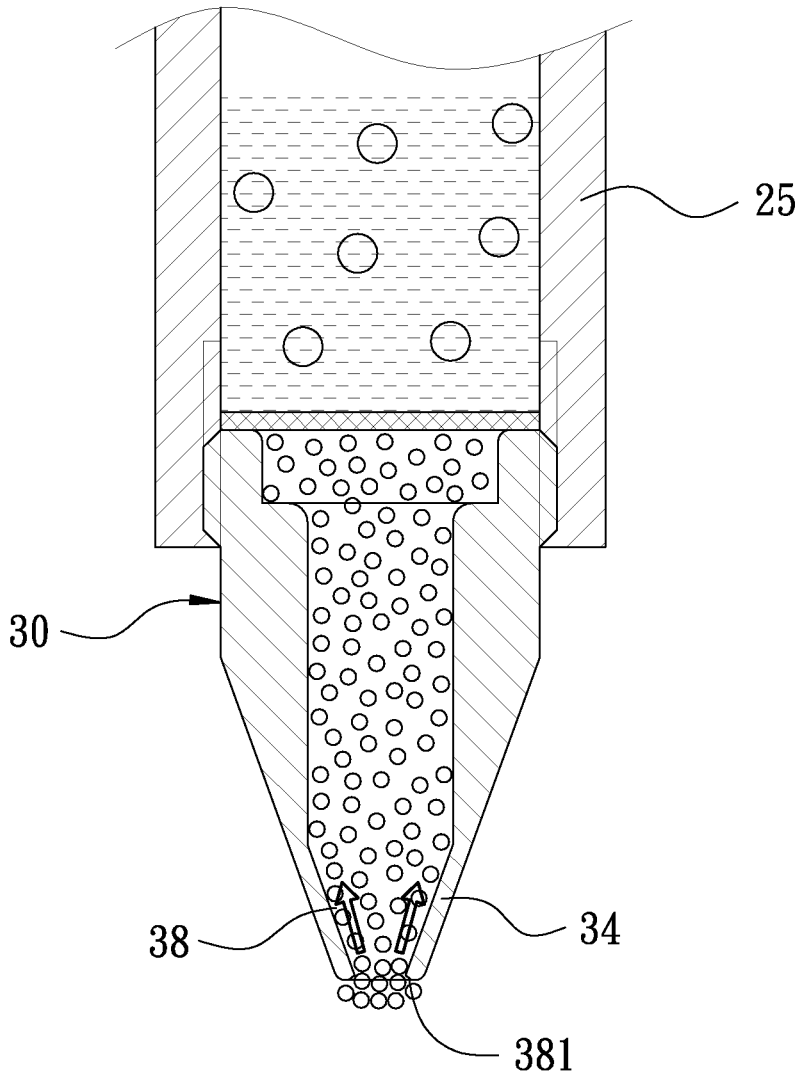
FIG. 5 is a third schematic view in accordance with the first embodiment of the present invention when in use.

Besides, when the discharge is completed, the liquid soap in the soap bottle 20 and the conveying member 21 generates a reaction force to suck the liquid soap back. The inner diameter of the discharge outlet 381 is gradually increased outward, so the backflow of the liquid soap is smoother. As shown in FIG. 5, the reduced portion 34 and the discharge outlet 381 can reduce the area that the liquid soap is adsorbed to the soap dispensing nozzle 30 by the tension. There is no excessive residual foam to form water droplets, thereby solving the problem of cleaning.

Figure 6:
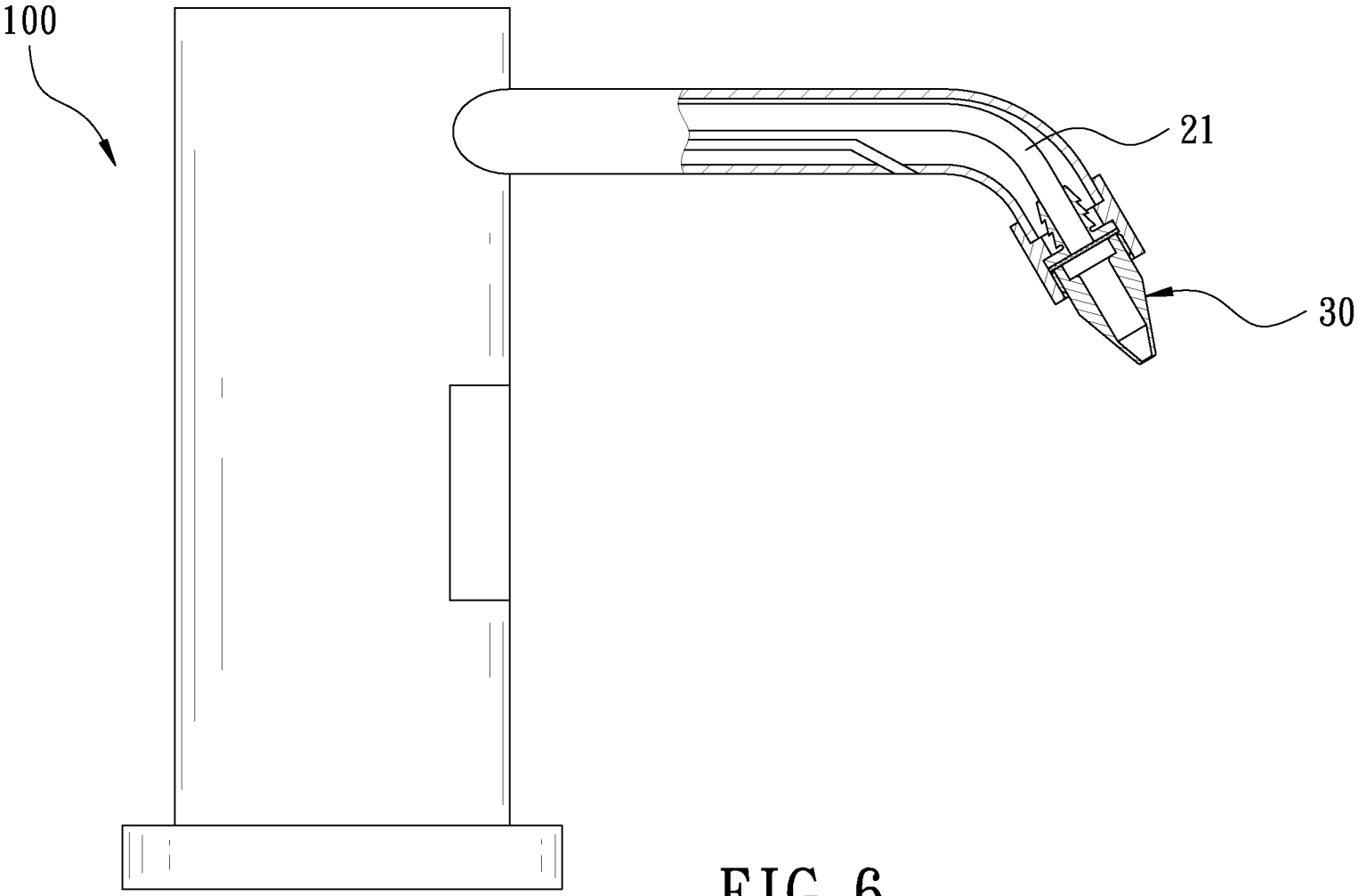
FIG. 6 is a cross-sectional view in accordance with a second embodiment of the present invention.

FIG. 6 is a cross-sectional view in accordance with a second embodiment of the present invention. The second embodiment of the present invention is an automatic soap dispenser for dispensing liquid soap, which differs from the first embodiment in that the dispensing member 22 is only connected to the soap bottle 20. The automatic soap dispenser can be aerated. The soap dispensing nozzle 30 is not provided with the foaming net 361. When the user's hand is close to the soap dispenser 100, the liquid soap is conveyed to the soap dispensing nozzle 30 via the conveying member 21 to output a quantitative amount of liquid soap for the user to use. When the discharge is completed, there is no excessive residual foam on the soap dispensing nozzle 30 to form water droplets, thereby solving the problem of cleaning and reducing the consumption of the liquid soap.

In addition, the dispensing member 22 may be a manual press device, and the foaming net 361 is used for foaming Thereby, the user can press the dispensing member 22 to output the liquid soap for the user to use. However, the force of the manual press device depends on how much the user presses. When the press force is less, the force of the discharge is generally less. However, the pressurizing hole 38 of the present invention enables the force of the discharge to be strong, and a suck-back effect is generated after the discharge is completed. There is no excessive residual foam on the soap dispensing nozzle 30 to form water droplets, thereby solving the problem of cleaning and reducing the consumption of the liquid soap.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A soap dispensing nozzle structure, comprising:

a soap dispensing nozzle, including a nozzle body, the nozzle body having a mounting portion, a body portion and a reduced portion that are arranged from top to bottom in sequence, the nozzle body having a passage therein, the passage having a straight hole and a pressurizing hole, the pressurizing hole having a diameter that is reduced downward, the soap dispensing nozzle having a discharge outlet at an exit of the pressurizing hole, the passage having a foaming hole, the foaming hole being in communication with the dispensing opening, the straight hole being in communication with the foaming hole, a curved annular surface being formed between the straight hole and the foaming hole, and one side of the foaming hole being provided with a foaming net.

2. The soap dispensing nozzle structure as claimed in claim 1, wherein an outer surface of the mounting portion is formed with a thread.

3. The soap dispensing nozzle structure as claimed in claim 1, wherein the reduced portion has an outer diameter that is gradually reduced downward from the body portion so that the reduced portion is slightly tapered, and the discharge outlet has an inner diameter that is gradually increased outward.

4. The soap dispensing nozzle structure as claimed in claim 1, wherein the foaming hole is located in the mounting portion, the straight hole is located in body portion, the pressurizing hole is in communication with the straight hole, and the pressurizing hole is located in the reduced portion.

5. A soap dispensing nozzle structure, mounted to a soap dispenser, the soap dispenser comprising a soap bottle, the soap bottle being connected with a conveying member, the conveying member being connected with a dispensing member, the dispensing member having a dispensing opening, the dispensing opening being provided with a joint, the joint being connected with a soap dispensing nozzle, characterized by:

the soap dispensing nozzle including a nozzle body, the nozzle body having a mounting portion, a body portion and a reduced portion that are arranged from top to bottom in sequence, the mounting portion being coupled to the joint, the nozzle body having a passage therein, the passage having a straight hole and a pressurizing hole, the pressurizing hole having a diameter that is reduced downward, the soap dispensing nozzle having a discharge outlet at an exit of the pressurizing hole, the passage having a foaming hole, the foaming hole being in communication with the dispensing opening, the straight hole being in communication with the foaming hole, a curved annular surface being formed between the straight hole and the foaming hole, and one side of the foaming hole being provided with a foaming net.

6. The soap dispensing nozzle structure as claimed in claim 5, wherein an outer surface of the mounting portion is formed with a thread to be coupled to the joint.

7. The soap dispensing nozzle structure as claimed in claim 5, wherein the reduced portion has an outer diameter that is gradually reduced downward from the body portion so that the reduced portion is slightly tapered, and the discharge outlet has an inner diameter that is gradually increased outward.

8. The soap dispensing nozzle structure as claimed in claim 5, wherein the foaming hole is located in the mounting portion, the straight hole is located in body portion, the pressurizing hole is in communication with the straight hole, and the pressurizing hole is located in the reduced portion.

* * * * *